US008485518B2

(12) United States Patent
Sasaki

(10) Patent No.: US 8,485,518 B2
(45) Date of Patent: Jul. 16, 2013

(54) SHEET MEDIA FEEDING DEVICE, SHEET MEDIA SEPARATION METHOD, AND SHEET MEDIA PROCESSING DEVICE

(75) Inventor: Toshiyuki Sasaki, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/346,395

(22) Filed: Jan. 9, 2012

(65) Prior Publication Data

US 2012/0104684 A1 May 3, 2012

Related U.S. Application Data

(62) Division of application No. 11/978,044, filed on Oct. 25, 2007, now abandoned.

(30) Foreign Application Priority Data

Oct. 26, 2006 (JP) ..... 2006-290820
Feb. 19, 2007 (JP) ..... 2007-037452

(51) Int. Cl.
*B65H 3/52* (2006.01)
*B65H 3/06* (2006.01)

(52) U.S. Cl.
USPC ..... 271/121; 271/109

(58) Field of Classification Search
USPC ..... 271/121, 126, 117, 109, 111
See application file for complete search history.

(56) References Cited

U.S. PATENT DOCUMENTS

| | | | | |
|---|---|---|---|---|
| 3,372,925 | A | 3/1968 | De Vries et al. | |
| 4,313,598 | A | 2/1982 | DiBlasio | |
| 4,541,623 | A | 9/1985 | Huerta | |
| 5,029,839 | A * | 7/1991 | Kajiwara et al. | 271/121 |
| 5,417,411 | A | 5/1995 | Kubota et al. | |
| 5,474,287 | A | 12/1995 | Takahashi | |
| 5,678,814 | A * | 10/1997 | Yokoyama et al. | 271/9.05 |
| 5,882,002 | A * | 3/1999 | Kamei et al. | 271/118 |
| 5,927,706 | A * | 7/1999 | Hiroi et al. | 271/117 |
| 6,017,031 | A | 1/2000 | Oosawa et al. | |
| 6,129,347 | A | 10/2000 | Brooks et al. | |
| 6,131,899 | A | 10/2000 | Nojima et al. | |
| 6,152,442 | A | 11/2000 | Nishinohara et al. | |

(Continued)

FOREIGN PATENT DOCUMENTS

| | | | |
|---|---|---|---|
| JP | 58-005154 | A | 1/1983 |
| JP | 59054443 | A | 3/1984 |

(Continued)

OTHER PUBLICATIONS

Office Action dated Dec. 12, 2008 in U.S. Appl. No. 11/978,044.

(Continued)

*Primary Examiner* — Patrick Cicchino
(74) *Attorney, Agent, or Firm* — Nutter McClennen & Fish LLP; John J. Penny, Jr.; Christina M. Sperry

(57) ABSTRACT

A sheet media feeding device comprising a media feed path for feeding sheet media; and a media separator for separating sheet media that are overlapping when advanced into the media feed path. The media separator includes a separation roller, a retard roller that is pressed against the separation roller and applies a torque load, and a media offsetting member for feeding the sheet media to a nipping part of the separation roller and the retard roller with the sheet media offset to the separation roller side.

17 Claims, 10 Drawing Sheets

U.S. PATENT DOCUMENTS

| | | | | |
|---|---|---|---|---|
| 6,182,961 | B1 | 2/2001 | Wenth, Jr. | |
| 6,431,541 | B2 * | 8/2002 | Kuo et al. | 271/118 |
| 6,467,767 | B2 | 10/2002 | Yano | |
| 6,609,707 | B1 | 8/2003 | Yano | |
| 7,374,162 | B2 | 5/2008 | Sonoda et al. | |
| 7,392,979 | B2 * | 7/2008 | Sasaki et al. | 271/120 |
| 7,543,811 | B2 * | 6/2009 | Shimamura | 271/124 |
| 7,976,016 | B2 | 7/2011 | Kinoshita | |
| 2004/0251588 | A1 | 12/2004 | Panini et al. | |
| 2004/0251592 | A1 | 12/2004 | Ruhe et al. | |
| 2004/0257626 | A1 | 12/2004 | Panini et al. | |
| 2005/0035531 | A1 * | 2/2005 | Sasaki et al. | 271/126 |
| 2006/0038339 | A1 | 2/2006 | Shimamura | |
| 2006/0082050 | A1 | 4/2006 | Wanibuchi et al. | |
| 2006/0210342 | A1 | 9/2006 | Fujikawa et al. | |
| 2007/0063421 | A1 * | 3/2007 | Demmeler et al. | 271/121 |
| 2007/0262511 | A1 * | 11/2007 | Ohshima et al. | 271/10.01 |
| 2008/0099980 | A1 | 5/2008 | Sasaki | |

FOREIGN PATENT DOCUMENTS

| | | | |
|---|---|---|---|
| JP | 61-083642 | A | 4/1986 |
| JP | 05058562 | A | 3/1993 |
| JP | 09202480 | A | 8/1997 |
| JP | 2001-048362 | A | 2/2001 |
| JP | 2004-206362 | A | 7/2004 |
| JP | 2005219891 | A | 8/2005 |
| JP | 2005314053 | A | 11/2005 |
| JP | 2006-143385 | A | 6/2006 |
| JP | 2006-143470 | A | 6/2006 |
| JP | 2006-159525 | A | 6/2006 |

OTHER PUBLICATIONS

Office Action dated Feb. 15, 2011 in U.S. Appl. No. 11/978,044.
Office Action dated Jan. 8, 2010 in U.S. Appl. No. 11/978,044.
Office Action dated Jul. 1, 2010 in U.S. Appl. No. 11/978,044.
Office Action dated Jun. 25, 2009 in U.S. Appl. No. 11/978,044.
Office Action dated Oct. 12, 2011 in U.S. Appl. No. 11/978,044.

* cited by examiner 8
19
31
36
37
32d
6(1)
6(2)
6(3)
601
19a
36a
37a
18
18a
9b
32c
32b
32a
9a
16
17a
6
9
35
17
32
34

SHEET MEDIA FEEDING DEVICE, SHEET MEDIA SEPARATION METHOD, AND SHEET MEDIA PROCESSING DEVICE

Priority is claimed under 35 U.S.C. §120 from U.S. patent application Ser. No. 11/978,044 filed on Oct. 25, 2007, which is hereby incorporated by reference in its entirety. Priority is claimed under 35 U.S.C. §119 from Japanese Patent Application Nos. 2006-290820 filed on Oct. 26, 2006 and JP 2007-037452 filed on Feb. 19, 2007, which are hereby incorporated by reference in their entirety.

BACKGROUND OF THE INVENTION

1. Technical Field

The present invention relates to a sheet media feeding device and to a sheet media separation method for separating and feeding sheet media such as checks and printing paper one sheet at a time. The invention also relates to a sheet media processing device such as a check reading device, a printer, a scanner, or a magnetic reading device that has a sheet media feeding device.

2. Description of Related Art

In banks and other financial institutions checks and check-like instruments (negotiable securities) are passed through a check reader to read an image of the front of the check and the magnetic ink characters and sort the instruments based on the result of this reading operation. As electronic check processing has become more common, the scanned check image data and magnetic ink character data are processed by a computer and the check instruments are managed by computer. Check processing systems of this type are taught, for example, in JP2004-206362(A), US2004/0257626(A), and US2004/0251588(A).

In order to accurately read the check information, the checks must be fed one at a time and conveyed passed the reading position of the magnetic head that is used for magnetic ink character reading and the reading position of the scanner that is used to image the check. If plural checks are overlapping as they are transported, the information cannot be accurately read and the checks may jam in the transportation path.

Media separation methods for feeding checks and other sheet media that are held in a stack one sheet at a time include methods that separate the sheet media from the stack by pressing the sheet media against a separation pad that is made from a material with a high coefficient of friction while feeding the sheets, and methods (retard roller methods) that separate the sheet media by passing the media between a separation roller against which the media are pressed and a retard roller that applies a torque load. See, for example, JP2001-48362(A).

In JP2001-48362(A), which teaches a sheet media supply mechanism that is suitable for separating and feeding high rigidity sheets one at a time, a separation pad is pivotally supported so that the contact surface of the separation pad presses tightly against the surface of the sheets being fed from the cassette case and prevents the sheets from being fed in a bundle to the retard roller-type separation roller pair. The sheet that is in contact with the separation pad is not fed by the media separation mechanism taught in JP2001-48362(A) because the separation pad is pressed against the sheet. However, when plural sheets are stacked together it is still possible for sheets that are not in contact with the separation pad to be fed as a bundle to the separation roller pair due to the friction between the sheets.

If two overlapping sheets are fed together to the retard-roller-type separation roller pair, the sheet on the retard roller side is prevented from being fed and only one sheet is supplied from the separation roller pair. However, if three or more sheets are fed as a bundle into the separation roller pair, the one sheet in contact with the retard roller is prevented from being advanced but a plurality of the other sheets may pass as a stack through the separation roller pair without separating from each other due to the friction between the sheets.

SUMMARY OF THE INVENTION

The sheet media feeding device and the sheet media separation method of the invention enable separating and sequentially feeding the sheet media one sheet at a time even if three or more sheet media are fed together toward the retard roller-type separation mechanism.

Other objects and attainments together with a fuller understanding of the invention will become apparent and appreciated by referring to the following description and claims taken in conjunction with the accompanying drawings.

DESCRIPTION OF PREFERRED EMBODIMENTS

Preferred embodiments of a sheet media processing device having the sheet media feeding device according to the present invention are described below with reference to the accompanying figures.

Embodiment 1

A first embodiment of a check processing device employing the invention is described with reference to FIG. 1 to FIG. 7.

General Configuration

Figure 1:
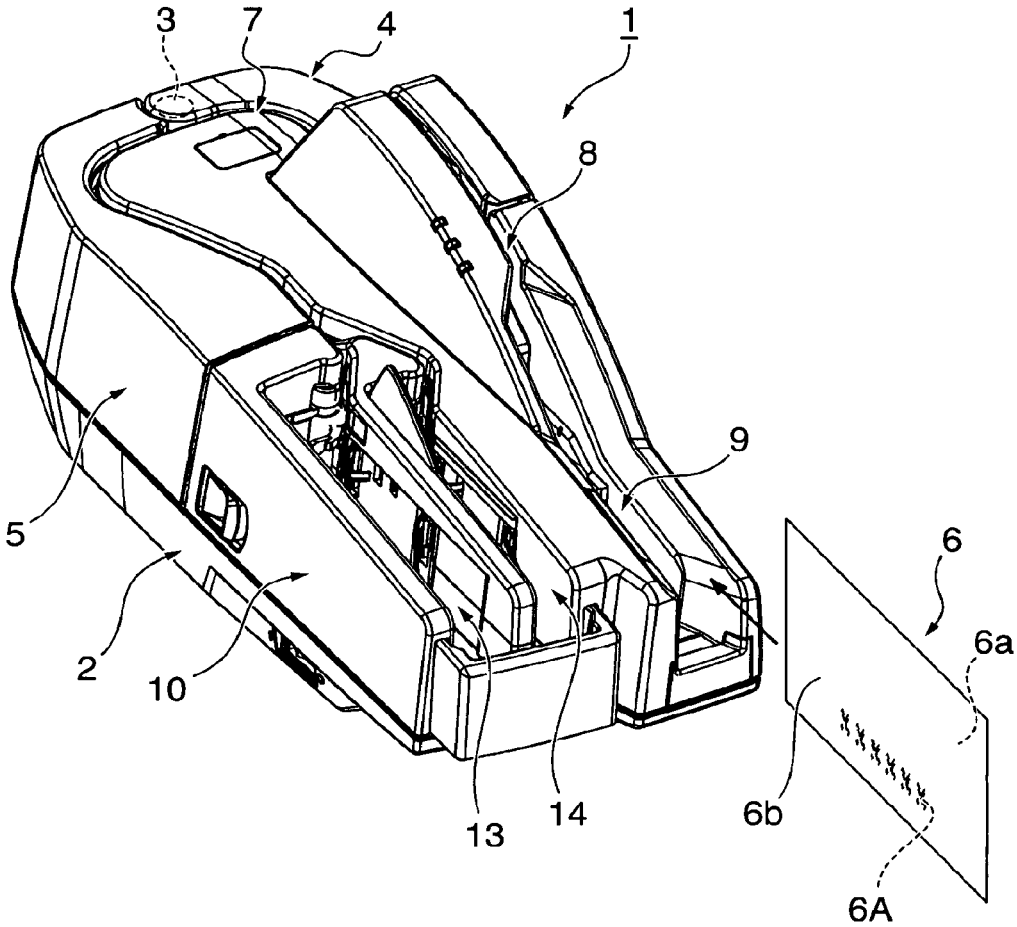
FIG. 1 is an oblique view of a first embodiment of a check processing device incorporating the invention.
Figure 2:
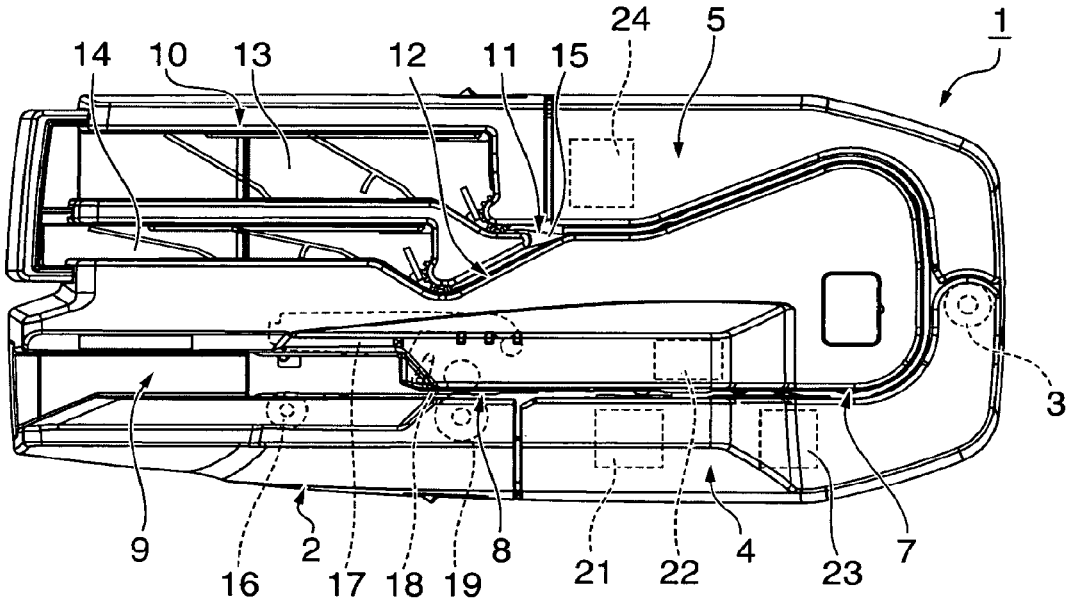
FIG. 2 is a plan view of the check processing device shown in FIG. 1.

FIG. 1 and FIG. 2 are an oblique view and a plan view, respectively, of a check processing device according to a first embodiment of the invention. This check processing device 1 has a main case 2 on the base and openable covers 4 and 5 that can open and close to the right and left pivoting on a vertical shaft 3 installed to an end part of the main case 2. A check transportation path 7 for conveying checks 6 is formed between the main case 2 and the openable covers 4 and 5.

The check transportation path 7 is defined by a narrow vertical channel that extends in substantially a U-shaped path when seen from above. The upstream end of the check transportation path 7 in the check transportation direction is connected through a check feeding channel 8, which is a narrow vertical slot, to a check insertion unit 9, which is a wide vertical slot. The downstream of the check transportation path 7 is connected to a check storage unit 10.

The check storage unit 10 has first and second diversion paths 11 and 12, which are narrow vertical channels connected to the downstream end of the check transportation path 7, a first storage pocket 13 and a second storage pocket 14 that are connected to the downstream ends of the diversion paths, and a gate lever 15 that switches position to direct the checks 6 into one of the storage pockets 13 and 14.

As shown in FIG. 1 the checks 6 have a magnetic ink character line 6A printed lengthwise along the bottom edge part of the check front 6*a*. The check amount, payer, check number, and signature are also recorded on the check front 6*a* against a specific background pattern, and an endorsement line is provided on the check back 6*b*. The checks 6 are inserted to the check insertion unit 9 with the tops and bottoms aligned and the check front 6*a* facing the outside of the U-shaped check transportation path 7.

A check feeding mechanism for delivering the checks 6, which are loaded in a batch of multiple checks, one at a time through the check feeding channel 8 into the check transportation path 7 is assembled in the check insertion unit 9. The check insertion unit 9 and this check feeding mechanism together render a check feeding device. As shown by the dotted lines in FIG. 2, the check feeding mechanism includes a pickup roller 16 for feeding the checks 6 inserted to the check insertion unit 9 into the check feeding channel 8, and a pressing member 17 for pressing the checks 6 against the pickup roller 16. A separation mechanism includes a separation pad 18 and a separation unit 19 of the retard roller type for separating and feeding the checks 6 conveyed along the check feeding channel 8 one at a time into the check transportation path 7. The check feeding mechanism is described in detail below with reference to FIG. 5.

As indicated by the dotted lines in FIG. 2, a front contact image scanner 21 for imaging the front of the check 6, a back contact image scanner 22 for imaging the back of the check 6, a magnetic head 23 for reading magnetic ink characters, and a printing mechanism 24 for printing "ELECTRONIC FUNDS TRANSFER," for example, on the check front are disposed in this order along the check transportation path 7.

After a check 6 is delivered from the check insertion unit 9 through the check feeding channel 8 and then travels through the check transportation path 7, the front and back sides of the check 6 are imaged and the magnetic ink character line 6A printed on the check front 6*a* is read. Then the check travels through the check transportation path 7. If this information is read normally, "ELECTRONIC FUNDS TRANSFER" or other information is printed on the check 6, and the check 6 is delivered to and stored in the first storage pocket 13. Checks 6 that cannot be scanned or read correctly are not printed and are diverted to and stored in the second storage pocket 14.

Control System

Figure 3:
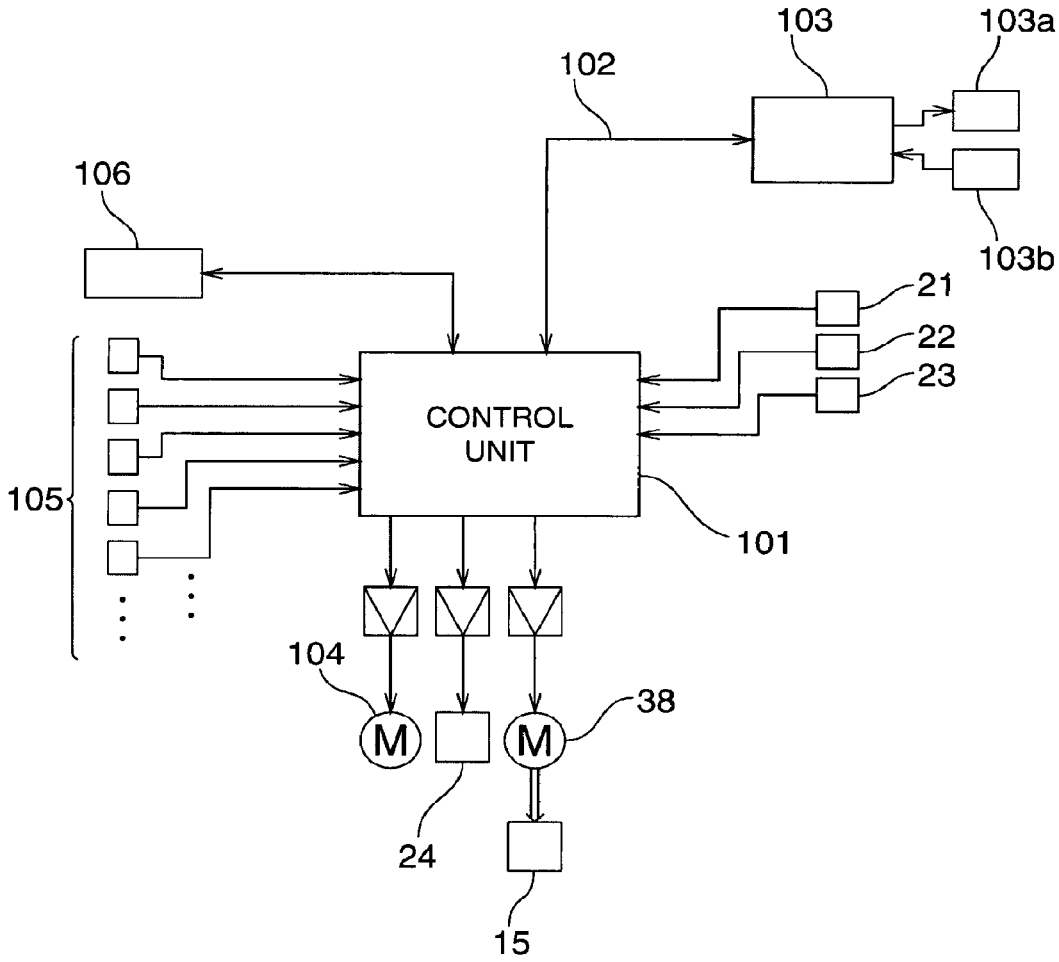
FIG. 3 is a schematic block diagram of the control system of the check processing device shown in FIG. 1.

FIG. 3 is a schematic block diagram showing the control system of the check processing device 1. The control system of the check processing device 1 has a control unit 101 that is built around a CPU and has memory such as ROM or RAM. The control unit 101 is connected to a host computer system 103 by a communication cable 102.

The computer system 103 has a display 103*a* and input/output devices such as a keyboard, mouse, or other operating unit 103*b*, and commands such as a start command for the check reading operation are input from the computer system 103 to the control unit 101.

When a command to start check reading is received, the control unit 101 drives the transportation motor 104 for check transportation to feed a check 6 into the check transportation path 7 and convey the fed check 6 through the check transportation path 7. The front image data, back image data, and the magnetic ink character information from the check 6 that was captured by the front contact image scanner 21, the back contact image scanner 22, and the magnetic head 23 are input to the control unit 101. This information is then supplied to the computer system 103 for image processing and character recognition and deciding if the check was read correctly, and the result of this evaluation are then supplied to the control unit 101. The control unit 101 controls driving of the printing mechanism 24 and the gate lever 15 based on the result of this evaluation. Deciding whether the check was read normally could also be done by the control unit 101.

The control unit 101 controls transporting of the check 6 based on signals from a group of sensors 105 disposed at plural locations along the check transportation path 7. An operating unit 106 including a power switch and other operating switches disposed on the main case 2 is connected to the control unit 101.

Figure 4:
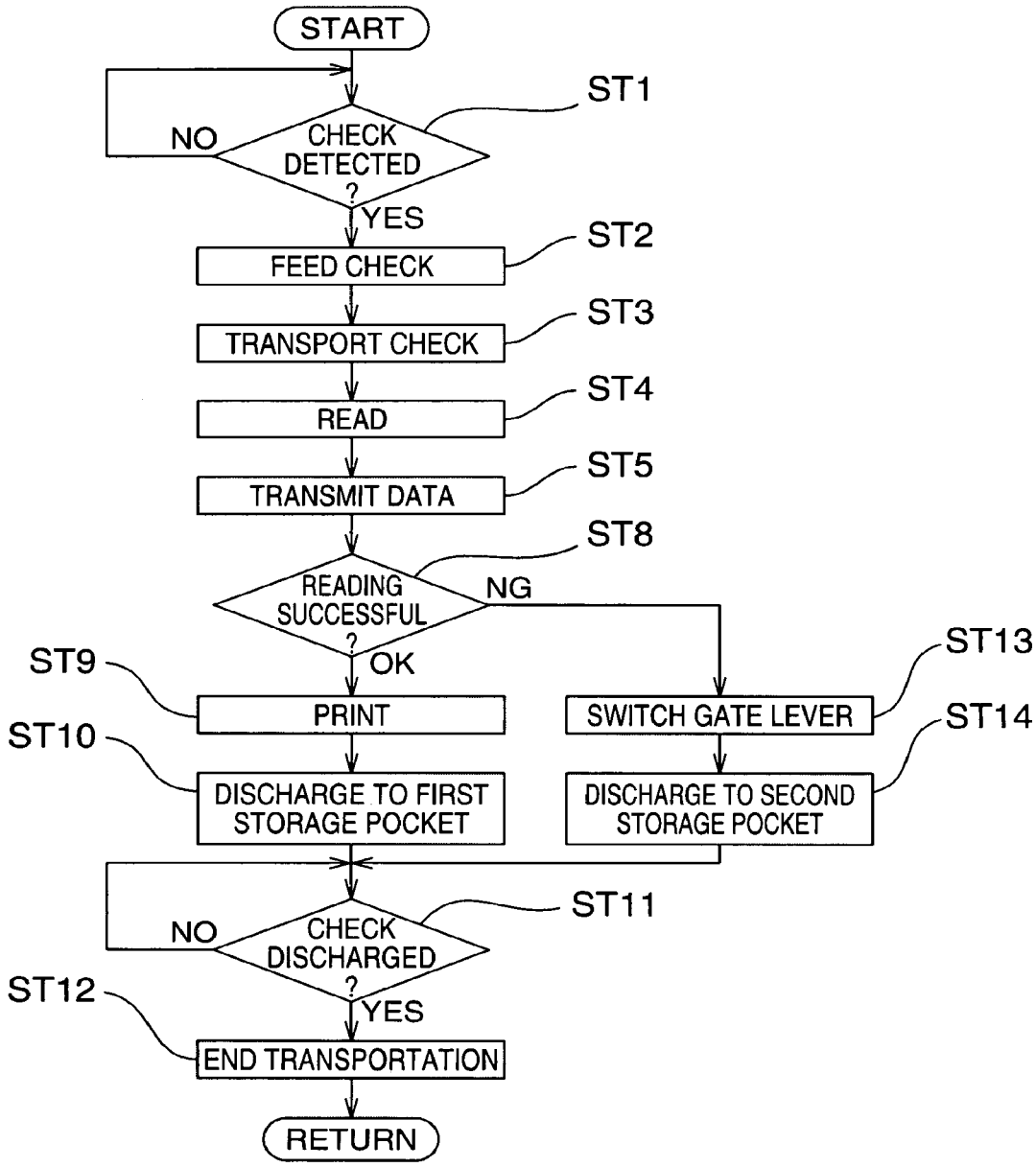
FIG. 4 is a flow chart describing the check processing operation of the check processing device shown in FIG. 1.

FIG. 4 is a flow chart showing an example of a check processing operation executed by the check processing device 1. When the operator inputs a command to start check reading from the operating unit 103*b* of the computer system 103, whether a check 6 was inserted to the check insertion unit 9 is detected. If insertion of a check is detected, the check 6 is fed from the check insertion unit 9 and the fed check 6 is transported along the check transportation path 7 (steps ST1, ST2, ST3). An image of the front, an image of the back, and the magnetic ink characters are then read from the conveyed check 6 by the front contact image scanner 21, the back contact image scanner 22, and the magnetic head 23, respectively (step ST4).

The read information is then sent via the communication cable 102 to the computer system 103 (step ST5). The computer system 103 then processes the front check image, the back check image, and the magnetic ink character information, and determines if the check was read normally. If the check 6 is transported upside down, the magnetic ink characters cannot be read and a read error results. This is because the magnetic ink character line 6A of the check 6 does not pass over the magnetic head 23. The magnetic ink character information also cannot be read if the check 6 is transported with the front and back reversed, and a read error therefore results. A read error is also returned if any part of the magnetic ink characters cannot be read because the check 6 is creased, torn, or skewed during transportation, for example. A read error is also returned if the amount or other information cannot be read from the front or back image data because the check 6 is creased, torn, or skewed during transportation, for example.

If the check was read normally, the check 6 is advanced and "ELECTRONIC FUNDS TRANSFER" or other information is printed by the printing mechanism 24, and the check 6 is discharged by the gate lever 15 into the first storage pocket 13 (steps ST8, ST9, ST10). The transportation operation ends when the check 6 is stored completely in the first storage pocket 13 (steps ST11, ST12).

If the check cannot be read or a read error results (step ST8), the position of the gate lever 15 is switched (step ST13). The printing mechanism 24 is also held in the standby position and does not print on the check 6. The check 6 is then diverted and discharged into the second storage pocket 14 by the gate lever 15 (step ST14). The transportation operation ends when the check 6 is stored completely in the second storage pocket 14 (steps ST11, ST12).

Check Feeding Device

Figure 5:
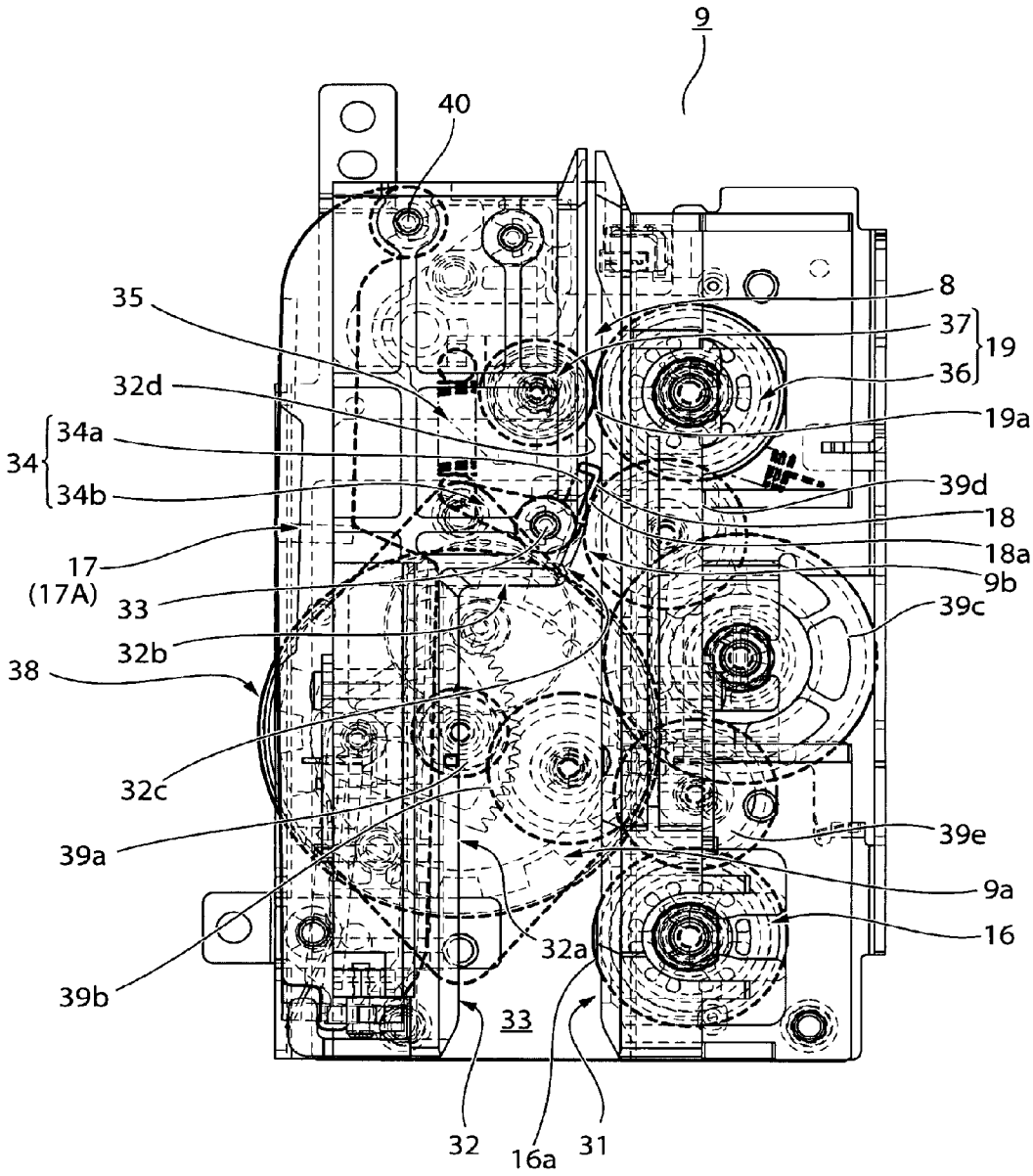
FIG. 5 is a schematic view showing the part where the check feeding mechanism is assembled in the check insertion unit of the check processing device shown in FIG. 1.
Figure 6B:
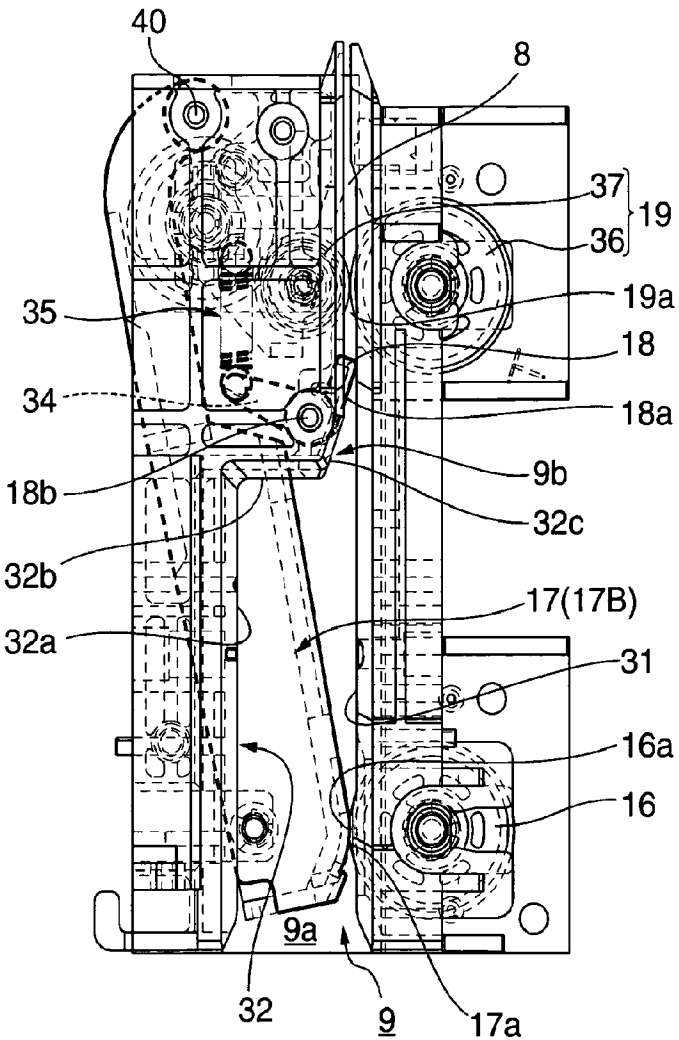
FIG. 6A and FIG. 6B describe the operation of the pressing member of the check feeding mechanism.
Figure 6A:
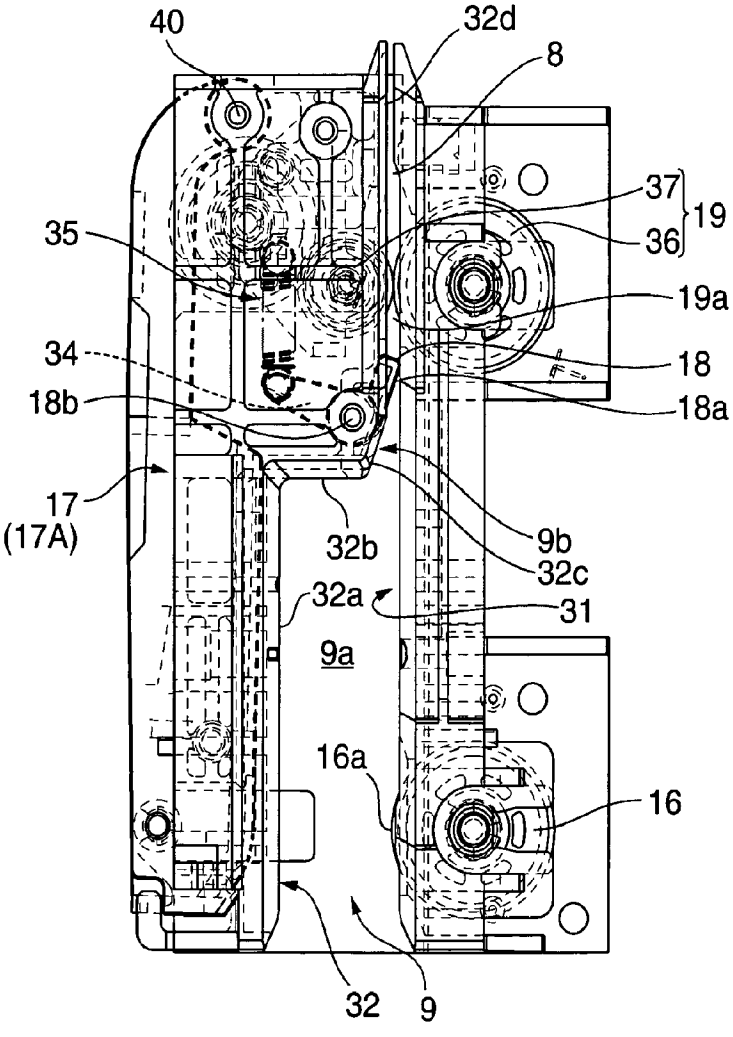

FIG. 5 is a schematic view showing the part of the check processing device 1 where the check insertion unit 9, in which the check feeding mechanism is assembled, is located. FIG. 6A and FIG. 6B describe the operation of the presser member.

The check insertion unit 9 is described first with reference to FIG. 5, FIG. 6A, and FIG. 6B. The check insertion unit 9 is basically defined by right and left first guide face 31 and second guide face 32, and a bottom 33. The first guide face 31 is a straight, flat vertical surface. The second guide face 32 includes a parallel guide surface part 32*a* that is parallel to and offset a specific distance from the first guide face 31, a perpendicular guide surface part 32*b*, an inclined guide surface part 32*c*, and a discharge-side parallel guide surface part 32*d*. The perpendicular guide surface part 32*b* bends approximately 90 degrees toward the first guide face 31 from the inside front end of the parallel guide surface part 32*a*. The inclined guide surface part 32*c* gradually approaches the first guide face 31 from the end of the perpendicular guide surface part 32*b*. The discharge-side parallel guide surface part 32*d* continues from the distal end of the inclined guide surface part 32*c* parallel to and opposite the first guide face 31 with a narrow gap therebetween.

The parallel guide surface part 32*a* of the second guide face 32 and the opposing first guide face 31 define the wide pocket 9*a* for inserting the checks 6. The width of the distal end of the check pocket 9*a* is narrowed by the perpendicular guide surface part 32*b*. A check feeder opening 9*b* is defined at the distal end of the check insertion unit 9 by the inclined guide surface part 32*c* and the opposing part of the first guide face 31 so that the width of the opening narrows gradually in the check feeding direction. The check feeding channel 8 with a specific narrow width is defined at the end of this check feeder opening 9*b* by the discharge-side parallel guide surface part 32*d* and the opposing part of the first guide face 31. The end of this check feeding channel 8 is connected to the check transportation path 7.

As described above, the check feeding mechanism has a pickup roller 16 and a pressing member 17. The pickup roller 16 feeds the checks 6 loaded in the check insertion unit 9 into the check feeding channel 8, and the pressing member 17 presses the checks 6 against the pickup roller 16. The check feeding mechanism 17 also has a separation mechanism including the separation pad 18 and the retard roller-type separation unit 19 for separating and feeding the checks 6 delivered along the check feeding channel 8 one at a time into the check transportation path 7.

The pickup roller 16 is disposed on the first guide face 31 toward the inside in the check feeding direction, and the outside surface 16*a* protrudes from the first guide face 31 into the check pocket 9*a*. An opening (not shown in the figure) is formed in the parallel guide surface part 32*a* of the second guide face 32 opposite the pickup roller 16, and the pressing member 17 can move in and out through this opening.

FIG. 6A shows the pressing member 17 in the retracted position, and FIG. 6B shows the pressing member 17 pivoted to the protruding position. As shown in these figures the pressing member 17 can pivot horizontally on a vertical pivot axis 40 disposed to the main case, and can pivot between a retracted position 17A retracted from the parallel guide surface part 32*a* of the second guide face 32 shown in FIG. 6A, and a protruding position 17B protruding into the check pocket 9*a* and pressing against the outside surface 16*a* of the pickup roller 16 as shown in FIG. 6B. The pressing member 17 is pivotally driven by a drive motor (not shown). If the drive motor is a stepping motor, the pivot position of the pressing member 17 can be controlled based on the number of steps the motor is driven.

The retracted position 17A of the pressing member 17 is detected by mechanical switches or other sensors (not shown in the figure) that are disposed on the main case. The pressing operation of the pressing member 17 against the checks 6 inserted in the check pocket 9*a* is permitted, for example, when a check 6 is detected by a transmission type optical sensor (not shown in the figure) that is disposed in the check insertion unit 9. When a check 6 is detected, a command from the computer system 103 (FIG. 3) that is the host device of the check processing device 1, or a manually asserted command, causes the pressing member 17 to pivot from the retracted position 17A to the pickup roller 16 and press the check 6 against the pickup roller 16.

The separation pad 18 (media offsetting member) disposed in the check feeding channel 8 is attached to an L-shaped support arm 34 that can pivot around a vertical support stud 18*b* attached to the main case. The support arm 34 has a distal end arm portion 34*a* and a proximal end arm portion 34*b* (see FIG. 5), and the part between these arm portions is supported to pivot freely on the vertical support stud 18*b*. The distal end arm portion 34*a* protrudes from the discharge-side parallel guide surface part 32*d* of the second guide face 32 into the check feeding channel 8, and the proximal end arm portion 34*b* extends away from the back of the discharge-side parallel guide surface part 32*d*.

A coil tension spring 35 is mounted between the proximal end arm portion 34*b* and a position on the main case. The force of this coil tension spring 35 constantly urges the distal end arm portion 34*a* to which the separation pad 18 is attached to pivot into the check feeding channel 8. In this embodiment the distal end of the separation pad 18 on the distal end arm portion 34*a* is always pressed to the first guide face 31 of the check feeding channel 8 and is held in a position blocking the check feeding channel 8. However, the separation pad can be movable and can retract to the second guide face 32.

When the separation pad 18 is pressed against the first guide face 31, the separation surface 18*a* (media offsetting surface) is set to an inclination angle of less than 90 degrees to the check feeding direction. In other words, the separation pad 18 is positioned so that the end of a check 6 that is fed into the check feeding channel 8 by the pickup roller 16 strikes the separation surface 18*a* at an angle of less than 90 degrees. This angle is further preferably in the range of approximately 10 degrees to approximately 40 degrees. The friction coefficient of the separation surface 18*a* of the separation pad 18 is set so that when pressed against the checks 6 the friction between the separation surface 18*a* and the checks 6 is greater than the friction coefficient between the checks 6 themselves. This characteristic can be achieved by appropriately selecting the material of the separation pad 18. The separation pad 18 is preferably plastic, and further preferably urethane foam. The urging force of the coil tension spring 35 on the separation pad 18 is set so that the check 6 fed by the pickup roller 16 can travel over the separation surface 18*a* while being pressed against the separation surface 18*a* of the separation pad 18.

The retard roller-type separation unit 19 located downstream from the separation pad 18 includes a separation roller 36 on the first guide face 31 side and a retard roller 37 on the other side. The nipping part 19*a* of the rollers is set to the middle of the width of the check feeding channel 8, and the retard roller 37 is pressed with prescribed pressure against the surface of the separation roller 36. The retard roller 37 applies a specific torque load to the check feeding direction by means of a torque limiter not shown.

The separation roller 36 is rotationally driven by the drive motor 38. As shown in FIG. 5, rotation of the drive motor 38 is transferred from the drive gear 39*a* through intervening gears 39*b* and 39*c* to the transfer gear 39*d*, and from the transfer gear 39*d* to the separation roller 36. The drive motor 38 is also used as the rotational drive source of the pickup roller 16, and torque from the motor is transferred to the pickup roller 16 through the drive gear 39*a*, gears 39*b* and 39*c*, and transfer gear 39*e*.

The check feeding operation of the check feeding device is described next with reference to FIG. 7A to FIG. 7D.

When a stack of checks 6 is inserted to the check insertion unit 9, the insertion of the checks 6 is detected by a sensor not shown. A command from the host device or manual operation then causes the pressing member 17 to pivot into the check insertion unit 9 and press the checks 6 against the pickup roller 16. As a result, the checks 6 that were loaded in a bundle into the check insertion unit 9 are pushed to the pickup roller 16 by the pressure surface 17*a* of the pressing member 17 at a position toward the inside as shown in FIG. 7A.

Figures 7A, 7B, 7C, 7D:
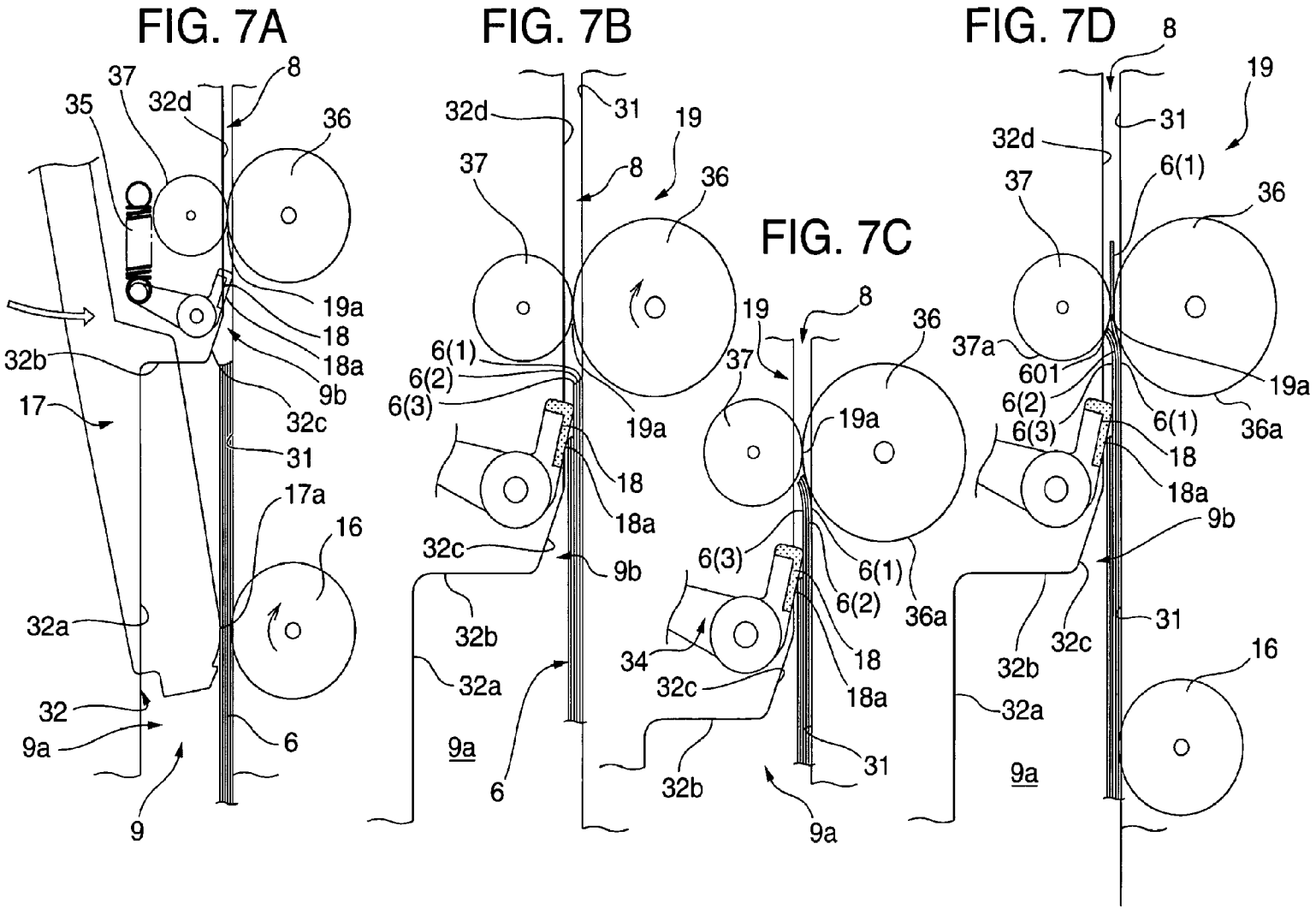
FIG. 7A to FIG. 7D describe the operation of the check feeding mechanism.

Next, as shown in FIG. 7B, the leading ends of the checks 6 that are fed into the check feeding channel 8 contact the separation surface 18*a* of the separation pad 18 that blocks the check feeding channel 8, and pass the separation pad 18 while pushing against the separation pad 18. As a result, of the checks 6 that are advanced stacked together, the check 6 on the side in contact with the high friction coefficient separation surface 18*a* separates from the other checks 6. Furthermore, because the separation pad 18 protrudes from the discharge-side parallel guide surface part 32*d* toward the first guide face 31, the checks 6 are pushed to the first guide face 31 side by the separation pad 18 and are pressed to the first guide face 31 while being fed towards the downstream separation unit 19.

The separation roller 36 and the nipping part 19*a* of the retard roller 37 are positioned approximately in the center of the width of the check feeding channel 8. As a result, as shown in FIG. 7C, the checks 6 that are advanced while being pressed to the first guide face 31 side (the separation roller 36 side) first contact the outside surface part 36*a* of the separation roller 36 before reaching the nipping part 19*a*, ride onto the outside surface part 36*a* and travel along the outside surface part 36*a* to the nipping part 19*a*.

In this example three checks 6(1) to 6(3) pass the separation pad 18 in a multifeed stack and are fed into the separation unit 19. In this case the one check 6(1) that contacts the outside surface part 36*a* of the separation roller 36 is guided by the outside surface part 36*a* to the nipping part 19*a*, passes through the nipping part 19*a* and is fed towards the check transportation path 7.

As shown in FIG. 7D, however, the leading end parts 601 of the other two checks 6(2) and 6(3) separate from the nipping part 19*a* towards the retard roller 37 and contact the outside surface 37*a* of the retard roller 37 before the nipping area. Because these checks 6(2) and 6(3) are advanced from the separation roller 36 on the opposite side after riding onto the outside surface part 36*a* of the separation roller 36, these checks contact the outside surface 37*a* at a large angle to the outside surface 37*a*.

If the checks 6 are advanced substantially straight to the nipping part 19*a*, the leading end parts 601 of the checks 6 contact the outside surface 37*a* at a small angle to the tangent to the outside surface 37*a*. As a result, the check 6(2) makes substantially no contact with the outside surface 37*a* of the retard roller 37 and is advanced to the nipping part 19*a*. As a result, the check 6(2) that has substantially no contact with the retard roller 37 is fed into the nipping part 19*a* together with the check 6(1) on the separation roller 36 side and the two checks may be advanced together through the nipping part 19*a*.

However, because the checks are offset towards the separation roller 36 and ride onto the outside surface 36*a* of the roller before proceeding to the nipping part 19*a* in this aspect of the invention, the leading end parts 601 of the checks 6(2) and 6(3) contact the outside surface 37*a* of the retard roller 37 at a large angle to a tangent to the retard roller 37. This produces a large load that prevents the checks 6(2) and 6(3) from being fed into the nipping part 19*a*, and the checks are reliably prevented from being advanced to the nipping part 19*a*. As a result, only one check 6(1) passes the nipping part 19*a* and is fed downstream.

As described above, the checks 6 being fed are advanced toward the retard roller type separation unit 19 while being pressed by the separation pad 18 to the first guide face 31 side of the check feeding channel 8. As a result, only the check 6(1) that is in contact with the outside surface part 36*a* of the separation roller 36 passes the nipping part 19*a* and is advanced while the other checks 6(2), 6(3), and so forth contact the outside surface 37*a* of the retard roller 37 at a large angle to the tangent and are not advanced to the nipping part 19*a*. It is therefore possible to always reliably pass only one check 6 through the nipping part 19*a* into the check transportation path 7.

The check processing device 1 of this first embodiment of the invention can therefore reliably feed checks 6 one at a time from the check insertion unit 9. Read errors and situations in which reading is not possible because multiple overlapping checks 6 are fed together can therefore be avoided. Problems such as overlapping checks 6 jamming in the check transportation path 7 and stopping or interrupting operation can also be avoided.

A second embodiment of a check processing device in which the invention is used is described next with reference to FIG. 8 to FIG. 11.

General Configuration

Figure 8:
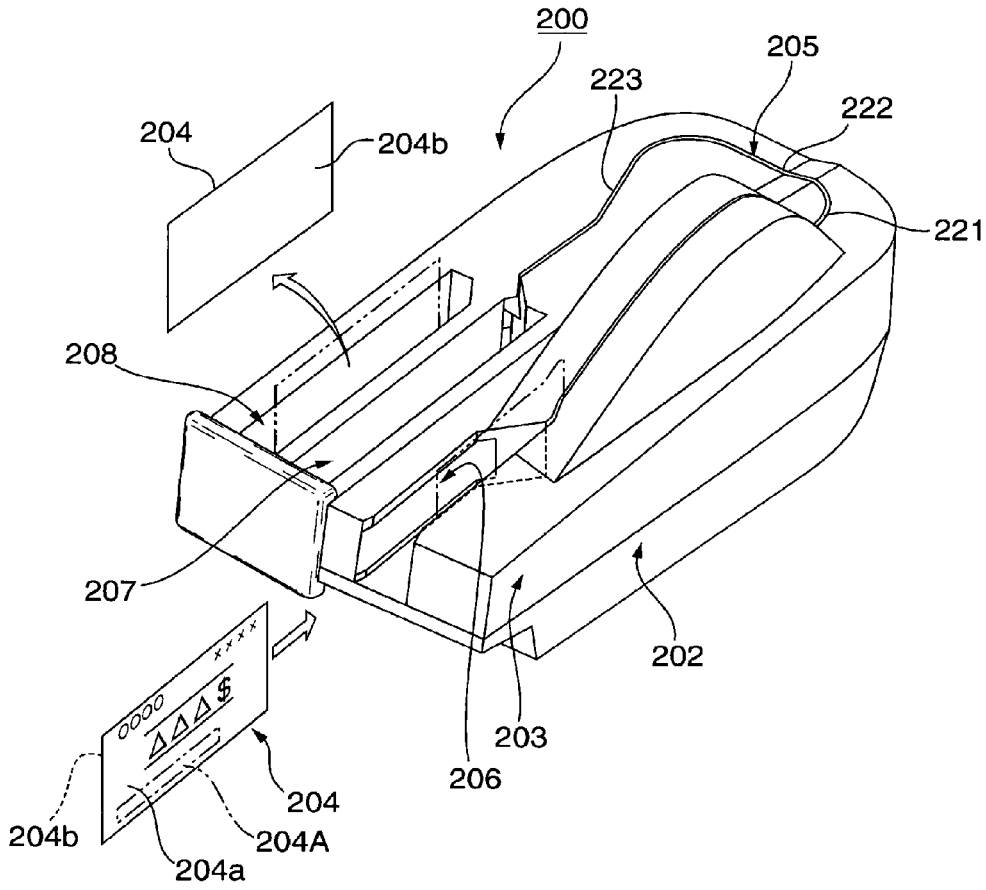
FIG. 8 is an oblique view of a second embodiment of a check processing device incorporating the invention.

FIG. 8 is an oblique view of a check processing device according to a second embodiment of the invention. The check processing device 200 of this second embodiment has a main case 202 and a cover case 203 covering the top of the main case 202, and various parts are assembled inside. A check transportation path 205 for conveying checks 204 is formed in the cover case 203 as a narrow vertical channel that is substantially U-shaped when seen from above.

One end of the check transportation path 205 is connected to a check insertion unit 206 that is a wide vertical slot, and the other end of the check transportation path 205 branches left and right and is connected to first and second check discharge units 207 and 208, both of which are wide vertical slots.

The checks 204 have a magnetic ink character line 204A printed lengthwise along the bottom edge part of the check front 204*a*. The check amount, payer, check number, and signature are also recorded on the check front 204*a* against a specific background pattern, and an endorsement line is provided on the check back 204*b*.

As unprocessed checks 204, which are loaded in a bundle standing on edge in the check insertion unit 206, travel through the check transportation path 205, the front and back sides of the check 204 are imaged and the magnetic ink character line 204A printed on the check front 204*a* is read. If this information is read normally, an endorsement is printed and the check 204 is directed and discharged into the first check discharge unit 207. If a read error occurs or reading is not possible, an endorsement is not printed and the check 204 is diverted and discharged into the second check discharge unit 208.

Figure 9:
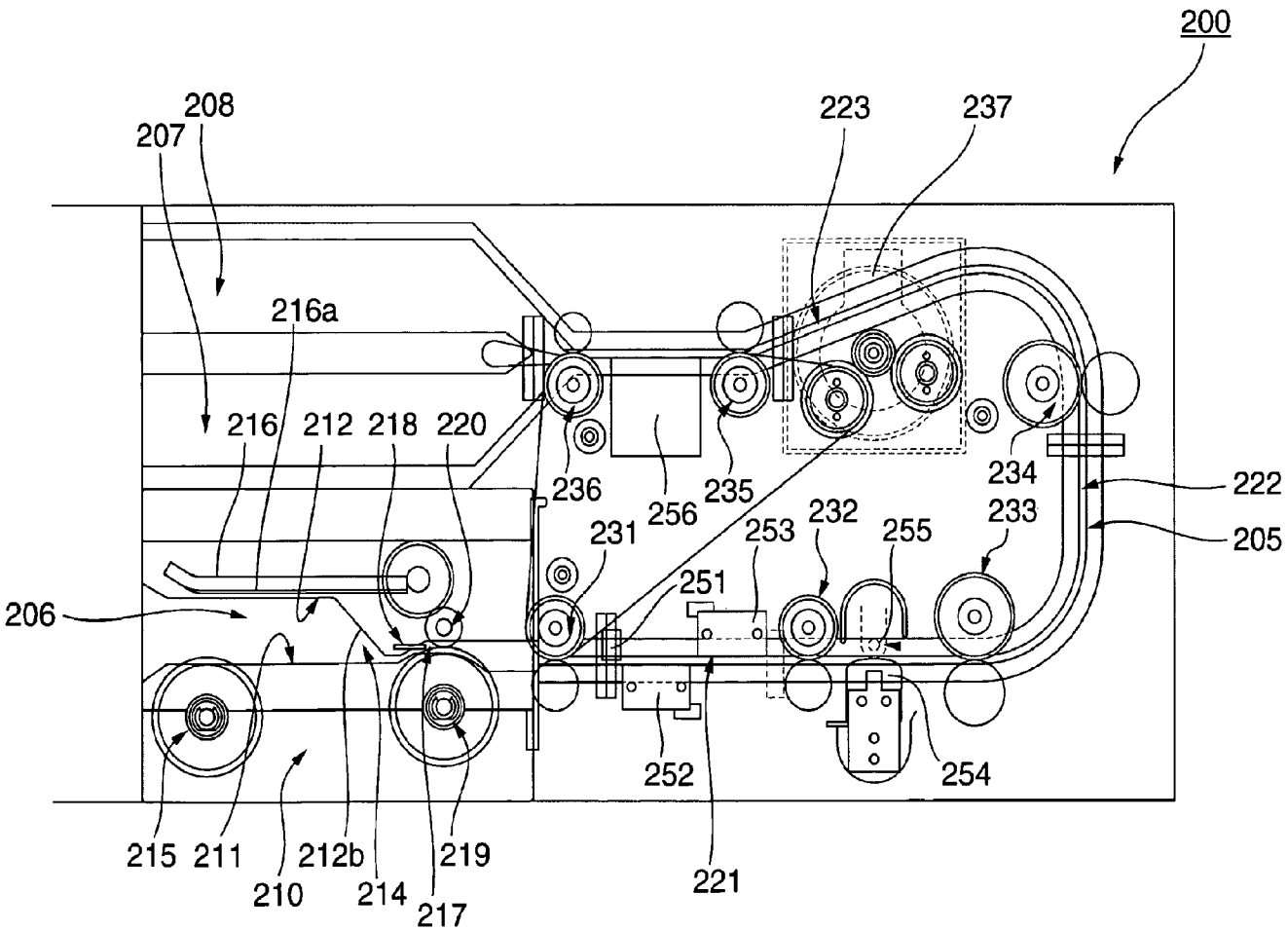
FIG. 9 describes the internal arrangement of the check processing device shown in FIG. 8.

FIG. 9 describes the internal structure of the check processing device 200. A check feeding mechanism 210 for feeding the checks 204, which are loaded in a stack, into the check transportation path 205 is assembled in the check insertion unit 206, and the check insertion unit 206 and this check feeding mechanism 210 together render a check feeding device (see FIG. 3).

The check transportation path 205 is a U-shaped path including an upstream-side transportation path portion 221 connected to the check insertion unit 206, a downstream-side transportation path portion 223 connected to the first and second check discharge units 207 and 208, and a curved transportation path portion 222 connecting the portions on the upstream and downstream sides. The transportation mechanism that conveys checks 204 fed from the check insertion unit 206 into the check transportation path 205 along the check transportation path 205 includes plural transportation roller pairs 231 to 236, such as six sets in this embodiment, positioned along the check transportation path 205, and a transportation motor 237 for rotationally driving the transportation roller pairs. A stepping motor, for example, is used as the transportation motor 237.

Disposed in order from the upstream side to the upstream-side transportation path portion 221 of the check transportation path 205 are a magnet 251 for magnetizing the magnetic ink characters, a front contact image sensor 252 as a front image reading means, a back contact image scanner 253 as a back image reading means, and a magnetic head 254 for magnetic ink character reading. A pressure roller 255 for pressing the checks 204 to the magnetic head is disposed opposite the magnetic head 254. A printing mechanism 256 for endorsement printing is disposed to the downstream-side transportation path portion 223 of the check transportation path 205. The printing mechanism 256 can move by means of a drive motor (not shown in the figure) between a printing position pressed against the check 204, and a standby position retracted from the printing position.

The control system of the check processing device 200 according to this second embodiment can be arranged in the same way as the check processing device 1 of the first embodiment.

Figure 10:
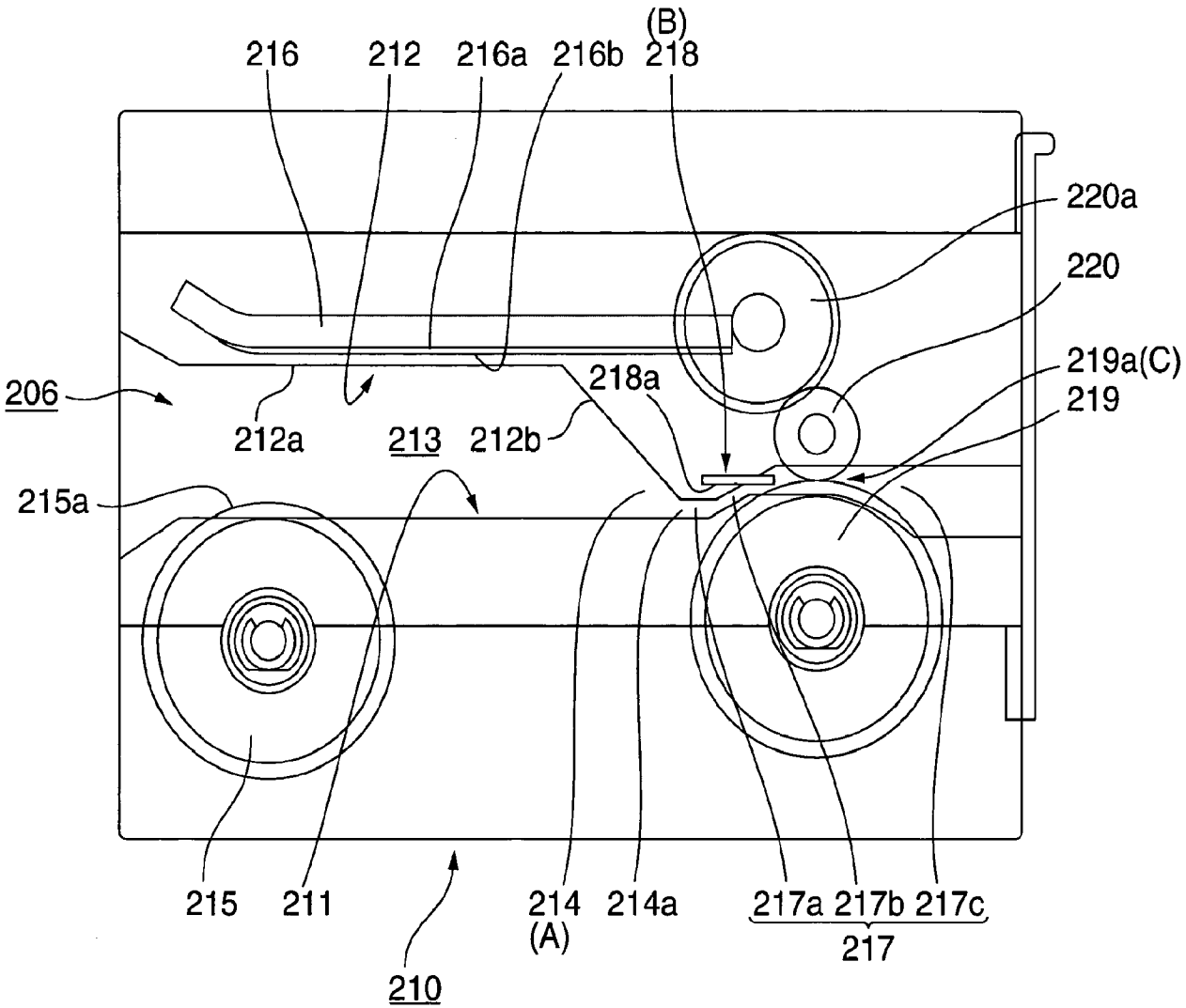
FIG. 10 is a schematic diagram of the check feeding device of the check processing device shown in FIG. 8.

FIG. 10 is a schematic diagram showing only the check feeding device including the check insertion unit 206 and the check feeding mechanism 210.

The check insertion unit 206 is defined by right and left first check guide face 211 and second check guide face 212, and a bottom 213. The first check guide face 211 is a straight, flat vertical surface. The second check guide face 212 includes a parallel vertical surface part 212*a* that is parallel to and offset a specific distance from the first check guide face 211, and an inclined vertical surface part 212*b* that is inclined at an angle of less than 90 degrees from the inside end of the parallel vertical surface part 212*a* towards the first check guide face 211 side. The inside end part of the first check guide face 211 and the inclined vertical surface part 212*b* of the second check guide face 212 define a check feed opening 214 of which the open width narrows gradually in the check feeding direction.

The check feeding mechanism 210 has a pickup roller 215 for advancing the checks 204, and a pressing member 216 for pressing the checks 204 against the pickup roller 215. The outside surface 215*a* of the pickup roller 215 protrudes from a position at the rear open end of the first check guide face 211. An opening (not shown in the figure) extending in the check transportation direction is formed in the second check guide face 212, and the pressing member 216 can move into and retract from the check insertion unit 206 through this opening. When, for example, a photosensor not shown detects that a check 204 was inserted to the check insertion unit 206, a drive mechanism not shown causes the pressing member 216 to advance and press the check 204 against the pickup roller 215 with a prescribed force.

A friction plate 216*a* made from cork or other high friction coefficient material is affixed to the surface of the pressing member 216. The friction between the surface of the friction plate 216*a*, that is, the check pressing surface 216*b*, and the check 204 is set to be greater than the friction between the checks.

The width of the distal opening 214*a* in the transportation direction of the check feed opening 214 narrows to a size enabling a plurality of checks 204 to pass simultaneously. A check feed path 217 is formed contiguously to this distal opening 214*a*. The check feed path 217 is defined by guide surface parts extending from the distal ends of the first check guide face 211 and the second check guide face 212.

The check feed path 217 includes a straight path portion 217*a* extending in the same direction as the first check guide face 211, an inclined path portion 217*b*, and a path portion 217*c*. The inclined path portion 217*b* continues from the straight path portion 217*a* and extends at a slight angle to the second check guide face 212 side. The path portion 217*c* continues from the inclined path portion 217*b* and extends as the path width gradually increases. The distal end of the path portion 217*c* communicates with the upstream end of the transportation path 205.

The open width of the straight path portion 217*a* is the same as the width of the distal opening 214*a* of the check feed opening 214. The inclined path portion 217*b* slopes at a specific angle to the straight path portion 217*a* and the width of the inclined path portion 217*b* is slightly narrower than the straight path portion 217*a*. The angle of inclination is preferably in the range of approximately 10 degrees to approximately 40 degrees in order to limit the number of checks 204 that are conveyed. A separation pad 218 extending parallel to the first check guide face 211 is disposed to the guide surface part extending from the second check guide face 212 in the inclined path portion 217*b*.

The separation pad 218 is a rectangular plate of a specific thickness and the same height as the inclined path portion 217*b*. The flat separation surface 218*a* of the separation pad 218 protrudes into the inclined path portion 217*b* to a position blocking half of the inclined path portion 217*b*. Because the separation pad 218 is positioned parallel to the straight path portion 217*a*, the leading end of a check 204 advanced along the inclined path portion 217*b* contacts the flat separation surface 218*a* at an approach angle of approximately 10 degrees to approximately 40 degrees. The separation pad 218 is made from a material with a high coefficient of friction such as EPDM (ethylene-propylene-diene monomer), EPT (ethylene-propylene-terpolymer), or other rubber elastomer.

A retard roller type separation unit is disposed in the path portion 217*c* on the downstream side of the separation pad 218. More specifically, a separation roller 219 is disposed on the first check guide face 211 side, and a retard roller 220 is disposed on the other side. The nipping part 219*a* of these rollers 219 and 220 is set approximately to the center of the width of the path portion 217*c*, and the retard roller 220 is pressed with prescribed pressure against the surface of the separation roller 219. A torque limiter 220*a* applies a torque load to the retard roller 220 and restricts rotation.

The pickup roller 215 and the separation roller 219 are driven rotationally by a feed motor not shown. The pickup roller 215 and the separation roller 219 start rotating simultaneously, and stop simultaneously when the leading end of the check 204 reaches the nipping part of the transportation roller pair 231 (see FIG. 9). The position of the check 204 is detected by a photosensor not shown.

Figure 11A:
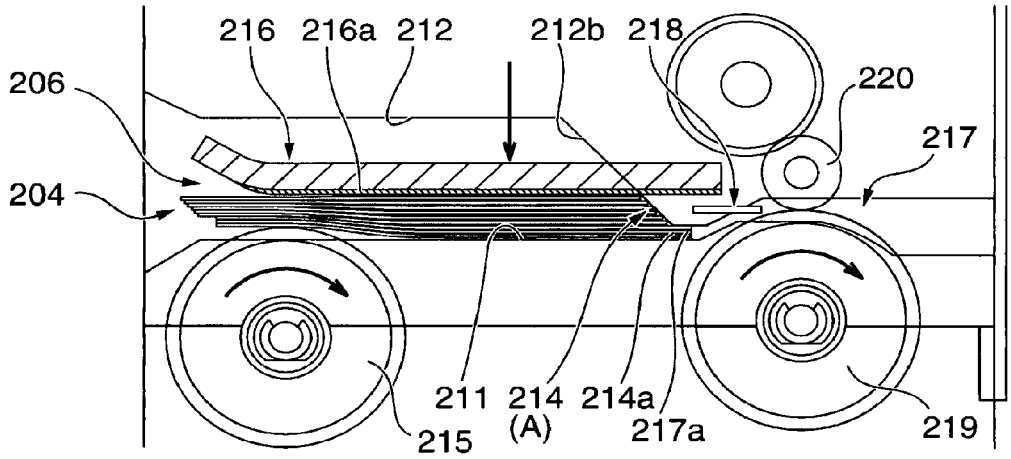
FIG. 11A to FIG. 11C describe the operation of the check feeding device shown in FIG. 10.
Figure 11B:
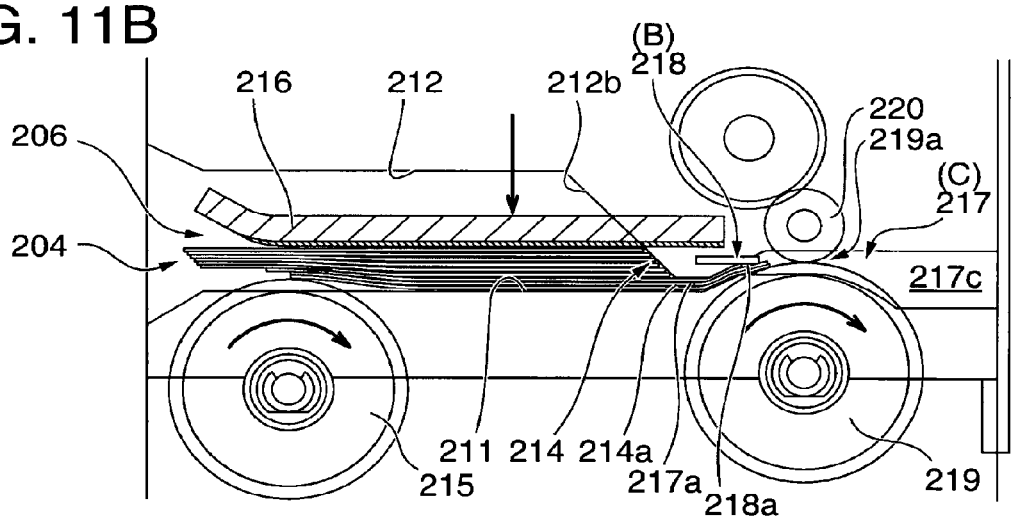
Figure 11C:
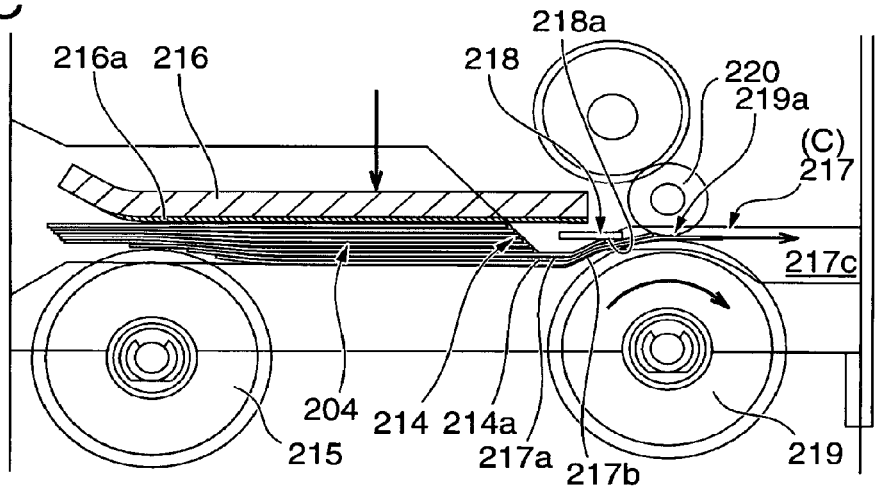

The check feeding operation of the check feeding device is described next with reference to FIG. 11A to FIG. 11C. A stack of many checks 204 is inserted in the check insertion unit 206. As shown in FIG. 11A, when the checks 204 are inserted, the pressing member 216 advances and presses the checks 204 with a prescribed pressure against the pickup roller 215. When the pickup roller 215 then rotates in the direction of the arrow, the checks 204 are fed towards the check feed opening 214.

The friction panel 216*a* is affixed to the surface of the pressing member 216 so that movement of the check group on the pressing member 216 side is limited and only the check group on the pickup roller 215 side advances. Because of this preliminary separation unit rendered by the friction panel 216*a*, only a group of checks on the pickup roller 215 side of the checks 204 in the check insertion unit 206 are advanced.

The inclined vertical surface part 212*b* that defines one surface of the check feed opening 214 gradually narrows the width of the check feed opening 214 in the check transportation direction. The leading ends of the checks 204 on the inclined vertical surface part 212*b* side therefore contact the inclined vertical surface part 212*b* and their movement is restricted. As a result, only a group of checks of a number that can pass the distal opening 214*a* of the check feed opening 214 are advanced from the distal opening 214*a* of the check feed opening 214 into the check feed path 217. The check feed opening 214 with a pointed end thus renders a first separation unit A, and this first separation unit A limits the size of the advanced check group to at most a few checks.

The check group that advances into the check feed path 217 then hits the flat separation surface 218*a* of the separation pad 218 at an approach angle in the range of approximately 10 degrees to approximately 40 degrees. As a result, the leading ends of the plural checks 204 that are advanced in a bunch are separated in the transportation direction by the flat separation surface 218*a* of the separation pad 218. Because the channel width at the downstream end of the separation pad 218 in the transportation direction is narrowed by the separation pad 218, at most about two checks 204 can pass. Therefore, as shown in FIG. 11B, the check group advanced by the pickup roller 215 is reduced to at most two overlapping checks 204 in this second check separation unit B rendered by the separation pad 218, and these few checks are fed into a third check separation unit C rendered by the nipping part 219*a* of the separation roller 219 and the retard roller 220.

Of the two checks 204 fed into the nipping part 219*a* of the rollers 219 and 220 (third check separation unit C), advancement of the check 204 on the retard roller 220 side is restricted and only the check 204 on the opposite side in contact with the separation roller 219 is advanced. More specifically, only one check 204 is fed into the check transportation path 205. Because only one or two checks are fed into the retard-roller-type third check separation unit C, the checks 204 are reliably separated one at a time by this separation unit C and fed one at a time into the check transportation path 205 as shown in FIG. 11C.

Furthermore, the checks 204 that are fed by the pickup roller 215 are advanced to the third check separation unit C while being pressed by the separation pad 218 against the first check guide face 211 side of the check feed path 217. More specifically, the checks are shifted to the first check guide face 211 side as they are fed into the nipping part 219*a* of the separation roller 219 and the retard roller 220. As a result, only the check 204 that contacts the surface of the separation roller 219 passes the nipping part 219*a* and is fed downstream. The other checks 204 contact the surface of the retard roller 220 at a large angle to the retard roller tangent. As a result, these other checks 204 are not advanced through the nipping part 219*a*. The check offsetting function of the separation pad 218 therefore also helps to ensure that only one check 204 ever passes the nipping part 219*a* and advances into the check transportation path 205.

As described above the check processing device 200 of this second embodiment reliably feeds the checks 204 one at a time from the check insertion unit 206. Read errors and situations in which reading is not possible because multiple overlapping checks 204 are fed together can therefore be avoided. Problems such as overlapping checks 204 jamming in the check transportation path 205 and stopping or interrupting operation can also be avoided.

The foregoing first and second embodiments of the invention are described using the check feeding device of a check processing device by way of example. The invention is not limited to being used in the check feeding device of a check processing device, however, and can be used in sheet media feeding devices for advancing different kinds of sheet media one sheet at a time. The invention can, for example, be used as a print paper feeding device for feeding paper one sheet at a time in a printer, a scanner, or a photocopier, for example.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A sheet media feeding device comprising:

a media insertion unit in which sheet media are inserted in a stack;

a media feeder opening that communicates the media insertion unit with a media feed path;

a pickup roller for feeding sheet media from the media insertion unit through the media feeder opening into the media feed path;

a pressure member for pressing the sheet media loaded in the media insertion unit against the pickup roller;

a first media separation unit formed by gradually reducing the width of the media feeder opening of the media insertion unit in the sheet media transportation direction;

a second media separation unit composed of a separation pad disposed to the media feed path; and a third media separation unit disposed to the media feed path on the downstream side of the separation pad;

wherein the third media separation unit includes a separation roller and a retard roller that is pressed against the separation roller and applies a torque load;

the separation pad of the second media separation unit is disposed so that the sheet media are offset to the separation roller side when advanced toward a nipping part of the separation roller and the retard roller; and the retard roller is restricted from rotation.

2. The sheet media feeding device described in claim 1, further comprising:

a first media guide surface and an opposing second media guide surface that define the media insertion unit and the media feeder opening;

wherein the outside surface part of the pickup roller protrudes from the first media guide surface to the media insertion unit;

the first media guide surface is a flat surface that extends substantially in a straight line; and the distal end part in the media transportation direction of the second media guide surface in the media insertion unit is an inclined surface that slopes toward the first media guide surface side.

3. The sheet media feeding device described in claim 1, wherein the nipping part is positioned approximately in a center of the width of the media feed path.

4. The sheet media feeding device described in claim 1, wherein:

the media feed path comprises a first side wall to which the separation roller is disposed, and a second side wall to which the retard roller is disposed; and the separation pad protrudes from the second side wall side into the media feed path.

5. The sheet media feeding device described in claim 4, further comprising:

a support unit that supports the separation pad so that the separation pad can advance into and retract from the media feed path from the second side wall side; and an urging member that urges and holds the separation pad protruding into the media feed path.

6. The sheet media feeding device described in claim 5, wherein:

the urging force of the urging member is set so that the separation pad is pressed against the sheet media traveling along the media feed path and can retract to the second side wall side.

7. The sheet media feeding device described in claim 6, wherein:

the separation pad is pressed to the first side wall by the urging force of the urging member.

8. The sheet media feeding device described in claim 1, wherein:

the separation pad comprises a media separation surface that the leading end of sheet media traveling through the media feed path contact at an approach angle of less than 90 degrees.

9. The sheet media feeding device described in claim 8, wherein:

the friction characteristic of the media separation surface is set so that the friction produced between the media separation surface and the sheet media is greater than the friction produced between the sheet media.

10. The sheet media feeding device described in claim 8, wherein said approach angle is in a range of approximately 10 degrees to approximately 40 degrees.

11. The sheet media feeding device described in claim 1, wherein:

the first media separation unit is configured to reduce a number of sheet media fed;

the second media separation unit is configured to further reduce the number of sheet media fed; and the third media separation unit is configured to further reduce the number of sheet media fed.

12. The sheet media feeding device described in claim 1, wherein leading edges of a plurality of the sheet media in the stack on a side of the stack facing the retard roller contact a surface of the retard roller when an outermost one of the sheet media in the stack on a side of the stack facing the separation roller contacts a surface of the separation roller before passing through the nipping part.

13. The sheet media feeding device described in claim 1, wherein:

the friction characteristic of the media pressing surface of the pressure member is set so that the friction produced between the media pressing surface and the sheet media is greater than the friction produced between the sheet media.

14. A sheet media separation method for a sheet media feeding device, the sheet media separation method comprising steps of:

pressing stacked sheet media against a pickup roller;

sequentially feeding the stacked sheet media by the pickup roller from a side of the sheet media contacting the pickup roller;

reducing the multifeed count of sheet media fed into the media feed path by a first separation operation that feeds sheet media fed by the pickup roller into the media feed path through a media feeder opening that gradually reduces the path width in the sheet media transportation direction;

reducing the multifeed count of the sheet media by a second separation operation that causes the leading ends of sheet media fed to the media feed path to contact a media separation surface of a separation pad disposed to the media feed path at an angle of less than 90 degrees and be fed along the media separation surface;

separating and feeding the sheet media one sheet at a time to the downstream side of the nipping part by a third separation operation that feeds the sheet media after passing the media separation surface through a nipping part of a separation roller and a retard roller; and restricting the retard roller from rotating;

wherein in the second separation operation using the separation pad the leading ends of the sheet media are guided over the surface of the separation roller to the nipping part by feeding the sheet media to the nipping part while offset to the separation roller side by the media separation surface; and preventing second sheet media, which are any of the sheet media fed in a multifeed state to the nipping part other than a first sheet touching the separation roller, from passing the nipping part by causing the leading ends of the second sheet media to contact an outside surface of the retard roller.

15. The sheet media separation method for a sheet media feeding device described in claim 14, further comprising steps of:

setting the friction produced between the sheet media and a media pressing surface of a pressure member that presses sheet media in a stack against the pickup roller greater than the friction produced between the sheet media; and a preliminary separation operation that limits the number of sheet media that are fed to the media feeder opening by the media pressing surface.

16. A sheet media separation method for a sheet media feeding device, the sheet media separation method comprising steps of:

pressing stacked sheet media against a pickup roller;

sequentially feeding the stacked sheet media by the pickup roller from a side of the sheet media contacting the pickup roller;

reducing the multifeed count of sheet media fed into the media feed path by a first separation operation that feeds sheet media fed by the pickup roller into the media feed path through a media feeder opening that gradually reduces the path width in the sheet media transportation direction;

reducing the multifeed count of the sheet media by a second separation operation that causes the leading ends of sheet media fed to the media feed path to contact a media separation surface of a separation pad disposed to the media feed path at an angle of less than 90 degrees and be fed along the media separation surface; and separating and feeding the sheet media one sheet at a time to the downstream side of the nipping part by a third separation operation that feeds the sheet media after passing the media separation surface through a nipping part of a separation roller and a retard roller;

wherein in the second separation operation using the separation pad the leading ends of the sheet media are guided over the surface of the separation roller to the nipping part by feeding the sheet media to the nipping part while offset to the separation roller side by the media separation surface;

preventing second sheet media, which are any of the sheet media fed in a multifeed state to the nipping part other than a first sheet touching the separation roller, from passing the nipping part by causing the leading ends of the second sheet media to contact an outside surface of the retard roller; and the retard roller applies a torque load in the sheet media transportation direction.

17. A sheet media feeding device comprising:

a media insertion unit in which sheet media are inserted in a stack;

a media feeder opening that communicates the media insertion unit with a media feed path;

a pickup roller for feeding sheet media from the media insertion unit through the media feeder opening into the media feed path;

a pressure member for pressing the sheet media loaded in the media insertion unit against the pickup roller;

a first media separation unit formed by gradually reducing the width of the media feeder opening of the media insertion unit in the sheet media transportation direction;

a second media separation unit composed of a separation pad disposed to the media feed path; and a third media separation unit disposed to the media feed path on the downstream side of the separation pad;

wherein the third media separation unit includes a separation roller and a retard roller that is pressed against the separation roller and applies a torque load;

the separation pad of the second media separation unit is disposed so that the sheet media are offset to the separation roller side when advanced toward a nipping part of the separation roller and the retard roller; and the retard roller applies the torque load in the sheet media transportation direction.

* * * * *